US007434688B2

(12) United States Patent
Hu

(10) Patent No.: US 7,434,688 B2
(45) Date of Patent: Oct. 14, 2008

(54) PORTABLE TOOLBOX

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 411 days.

(21) Appl. No.: 10/907,466

(22) Filed: Apr. 1, 2005

(65) Prior Publication Data

US 2006/0175217 A1 Aug. 10, 2006

(30) Foreign Application Priority Data

Feb. 5, 2005 (TW) ..... 94104079 A

(51) Int. Cl.
*B65D 85/28* (2006.01)

(52) U.S. Cl. ..... 206/377; 206/379

(58) Field of Classification Search ..... 206/372–379; 211/70.6

See application file for complete search history.

(56) References Cited

U.S. PATENT DOCUMENTS

| | | | | |
|---|---|---|---|---|
| 2,035,340 | A | 3/1936 | Primavera | 220/345.2 |
| 2,438,989 | A | 4/1948 | Billman | |
| 2,941,691 | A | 6/1960 | Weinberg | 220/345.2 |
| 3,081,056 | A | 3/1963 | Sweet et al. | 248/552 |
| 3,370,696 | A | 2/1968 | Gvoe | |
| 3,630,344 | A | 12/1971 | Bergh | 220/345.1 |
| 3,878,939 | A | 4/1975 | Wilcox | 206/373 |
| 3,926,308 | A | 12/1975 | Sullivan | 206/223 |
| 3,997,053 | A | 12/1976 | Bondhus | 206/377 |
| 4,069,915 | A | 1/1978 | Schurman | 206/305 |
| 4,310,094 | A | 1/1982 | Hotchkiss | 211/70.6 |
| 4,372,468 | A | 2/1983 | Harvey | 224/268 |
| 4,501,354 | A | 2/1985 | Hoffman | 206/77.1 |
| 4,711,352 | A | 12/1987 | Williams et al. | 206/365 |
| 4,819,800 | A | 4/1989 | Wilson | 206/373 |
| 4,880,122 | A | 11/1989 | Martindell | 211/70.6 |
| 4,911,297 | A | 3/1990 | Suburu | 206/376 |
| 4,997,085 | A | 3/1991 | Brennan | 206/376 |
| 5,036,975 | A | 8/1991 | Chow | 206/376 |
| 5,044,591 | A | 9/1991 | Huang | 248/317 |
| 5,108,287 | A | 4/1992 | Yee et al. | 433/77 |
| 5,123,532 | A * | 6/1992 | Rau et al. | 206/379 |
| 5,143,215 | A | 9/1992 | Hartley et al. | 206/461 |
| 5,203,469 | A | 4/1993 | Chang et al. | 220/812 |
| 5,322,256 | A | 6/1994 | Kanwischer | 248/312 |

(Continued)

FOREIGN PATENT DOCUMENTS

| | | |
|---|---|---|
| FR | 2701458 | 2/1993 |
| TW | 319154 | 11/1997 |

OTHER PUBLICATIONS

Taiwan Patent Publication No. 258066, Sep. 21, 1995, 4 pages.

*Primary Examiner*—Luan K Bui
(74) *Attorney, Agent, or Firm*—Alan Kamrath; Kamrath & Associates PA

(57) ABSTRACT

A portable toolbox is disclosed. The portable toolbox includes a frame and a holder. The holder can hold a plurality of bits. The holder is put in the frame so that the holder can be pivoted between a retreated position and an extended position relative to the frame. In the retreated position, the bits are kept in the holder in cooperation with the frame. In the extended position, the bits can be put onto and taken from the holder from two opposite sides of the frame.

17 Claims, 6 Drawing Sheets

U.S. PATENT DOCUMENTS 5,335,772 A 8/1994 Chervenak et al. ..... 206/349
5,346,063 A 9/1994 Chow ..... 206/376
D355,826 S 2/1995 Chow
5,415,315 A 5/1995 Ramirez ..... 220/346
5,526,929 A 6/1996 Wei ..... 206/378
5,535,881 A 7/1996 Krivec ..... 206/376
5,535,882 A 7/1996 Liu ..... 206/377
5,551,559 A 9/1996 Roth et al. ..... 206/308.1
5,562,208 A 10/1996 Hasler et al. ..... 206/373
5,595,294 A 1/1997 McKenzie et al. ..... 206/349
5,598,924 A 2/1997 McCann ..... 211/70.6
5,638,964 A 6/1997 Ernst ..... 211/70.6
5,659,440 A 8/1997 Acosta et al. ..... 294/169 X
5,713,467 A 2/1998 Kao ..... 206/349
5,730,303 A 3/1998 Chow ..... 211/70.6
5,782,347 A 7/1998 Fantone et al. ..... 206/308.1
5,788,303 A 8/1998 Chia-Hsiang ..... 294/143
5,803,253 A 9/1998 Zakarian ..... 206/349
5,803,254 A 9/1998 Vasudeva ..... 206/373
5,855,274 A 1/1999 Piao ..... 206/373
5,887,715 A 3/1999 Vasudera ..... 206/373
D409,906 S 5/1999 Hu ..... D9/415
5,899,329 A 5/1999 Hu et al. ..... 206/376
5,918,741 A 7/1999 Vasudeva ..... 206/376
5,931,299 A 8/1999 Hsieh ..... 206/376
5,941,386 A 8/1999 Hu et al. ..... 206/376
5,967,340 A 10/1999 Kao ..... 211/70.6
5,975,297 A 11/1999 Kao ..... 206/378
5,996,817 A 12/1999 Kao ..... 211/70.6
6,039,188 A 3/2000 Lee ..... 206/758
6,044,985 A 4/2000 Kao ..... 211/70.6
6,050,409 A * 4/2000 Delbeck et al. ..... 206/375
6,068,123 A 5/2000 Chen ..... 206/373
D426,151 S 6/2000 Ling ..... D9/415
6,076,669 A 6/2000 Ling ..... 206/349
6,092,656 A 7/2000 Ernst ..... 206/378
6,098,799 A 8/2000 Lee ..... 206/378
6,113,867 A 9/2000 Mayer ..... 422/300
6,126,004 A 10/2000 Ling ..... 206/377
D433,613 S 11/2000 Jialin ..... D8/71
6,186,323 B1 2/2001 Jansson et al. ..... 206/376 X
6,193,200 B1 2/2001 Kao ..... 248/309.1
6,202,864 B1 3/2001 Ernst et al. ..... 211/70.6
6,241,092 B1 6/2001 Vasudeva ..... 206/349
6,241,208 B1 6/2001 Lin ..... 248/309.1
6,257,409 B1 7/2001 Lin ..... 206/376
D446,651 S 8/2001 Liao ..... D3/905
6,283,311 B1 9/2001 Lee ..... 211/70.6
6,315,119 B1 11/2001 Lee ..... 206/349
6,315,121 B1 11/2001 Hansen ..... 206/376
6,360,892 B1 3/2002 Chen ..... 206/376
6,375,005 B1 4/2002 McCann ..... 206/349
6,378,700 B1 4/2002 Tong ..... 206/376
6,398,027 B1 6/2002 Ryu ..... 206/362
6,401,923 B1 6/2002 Huang ..... 206/376
6,425,482 B1 7/2002 Chiang ..... 206/349
6,464,840 B1 10/2002 McCann ..... 206/376
6,481,583 B1 11/2002 Black et al. ..... 211/70.6
6,508,360 B1 1/2003 Chen ..... 206/378
6,536,611 B2 3/2003 Chen ..... 211/70.6
D473,049 S 4/2003 Devine ..... D3/228
6,547,074 B1 4/2003 Chen ..... 206/379
6,564,949 B1 5/2003 Saathoff ..... 211/70.6
6,615,983 B1 * 9/2003 Yu ..... 206/372
6,637,606 B1 10/2003 Chen ..... 211/70.6
6,655,529 B2 12/2003 Ho ..... 206/373
6,679,379 B1 1/2004 Kao ..... 206/349
6,679,391 B1 1/2004 Huang ..... 211/70.6
6,742,653 B2 6/2004 Kao ..... 206/373
6,758,350 B2 7/2004 Lin ..... 211/70.6
6,827,210 B2 12/2004 Chen ..... 206/349
6,837,382 B2 1/2005 Chen ..... 211/70.6
6,840,389 B2 1/2005 Chen ..... 211/70.6
2002/0175257 A1 11/2002 Yen ..... 248/309.1
2003/0000902 A1 1/2003 Keis et al. ..... 211/89.01
2003/0034316 A1 2/2003 Kao ..... 211/70.6
2003/0102275 A1 6/2003 Kao ..... 211/70.6
2003/0234196 A1 12/2003 Hu
2004/0035731 A1 2/2004 Lee ..... 206/349
2004/0069668 A1 4/2004 Finnigan ..... 206/372
2004/0094444 A1 5/2004 Chen ..... 206/376
2004/0124106 A1 7/2004 Chen
2004/0200749 A1 10/2004 Wang ..... 206/373
2005/0211587 A1 * 9/2005 Chen ..... 206/379
2005/0241974 A1 * 11/2005 Chen ..... 206/379
2006/0118446 A1 * 6/2006 Liu ..... 206/373

* cited by examiner

PORTABLE TOOLBOX

BACKGROUND OF INVENTION

1. Field of Invention

The present invention relates to a portable toolbox.

2. Related Prior Art

In Taiwanese Patent Publication No. 258066, a portable toolbox includes a holder 1 and a cover 10. The holder 1 includes a plurality of sockets 5 formed on upper end thereof and two hooks 3 formed on a lower end thereof. The sockets 5 receive bits 30. The hooks 3 hold a spanner 40. The holder 1 includes a balcony 4 formed on a front end thereof and a clip 2 formed on a rear end thereof. The balcony 4 supports the cover 10 when the cover 10 is in a retreated position relative to the holder 1. The clip 2 is used for hanging the portable toolbox on a belt 50 worn on a user's waist. The holder 1 includes two sides formed thereon. Each of the sides includes a joint 6 formed thereon and a recess 7 defined therein. The cover 10 includes two lateral walls 12 and a cross wall 11 formed between the lateral walls 12. Each of the lateral walls 12 includes an aperture 13 defined therein and a boss 15 formed thereon. Each of the joints 6 of the holder 1 is inserted into corresponding one of the apertures 13 of the cover 10 so that the cover 10 is pivotally connected with the holder 1. The bosses 15 are put in the recesses 7 so that the cover 10 is kept in position relative to the holder 1. The cross wall 11 abuts the bits 30 in order to avoid the bits 30 escaping from the holder 1. The bits 30 are often dropped from the sockets 5 when a user stoops to take a bit 30 from the holder 1 while the cover 10 is opened. In addition, the spanner 40 is exposed outside of the holder 1. However, the spanner 40 easily contacts an object and drops because there is no cover to protect it from falling off the holder 1.

In U.S. Pat. No. 5,190,154, a box 1 is disclosed for receiving bits 27 and a corresponding chuck 14 or 39 of a screwdriver. The box 1 includes a bottom part 2 and a top part 3. A wall 12 is formed in the bottom part 2. The top part 3 is integrated with a shaft 11 installed on the bottom part 2. A ledge 24 is integrated with the shaft 11. The ledge 24 defines holes 25 each for receiving an end of a related bit 27. The wall 12 ensures the ends of the bits 27 in the holes 25 via blocking the opposite ends of the bits 27. However, taking the chuck 14 or 39 from the bottom part 2 may cause accidental falling of one or some of the bits 27 from the ledge 24 as they are all accessed to from a same side of the bottom part 2.

The present invention is therefore intended to obviate or at least alleviate the problems encountered in the prior art.

SUMMARY OF INVENTION

According to the present invention, a portable toolbox includes a frame and a holder. The holder can hold a plurality of bits. The holder is put in the frame so that the holder can be pivoted between a retreated position and an extended position relative to the frame. In the retreated position, the bits are kept in the holder in cooperation with the frame. In the extended position, the bits and tool can be put onto and taken from the holder from two opposite sides of the frame.

The primary advantage of the portable toolbox is that the bits are kept in the holder by the frame when the holder is in the retreated position.

Other advantages and novel features of the invention will become more apparent from the following detailed description when taken in conjunction with the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
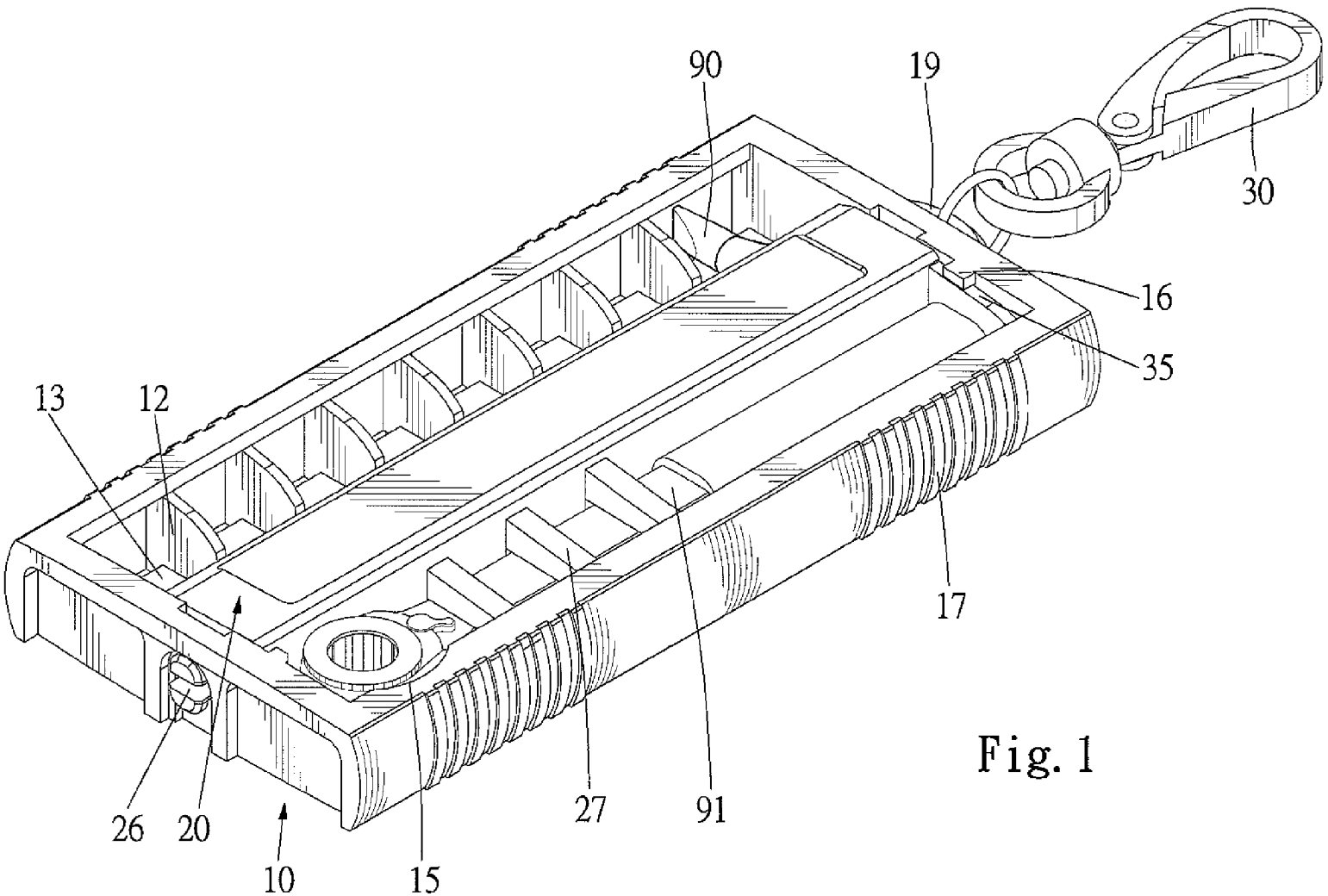
FIG. 1 is a perspective view of a portable toolbox according to the preferred embodiment of the present invention.
Figure 2:
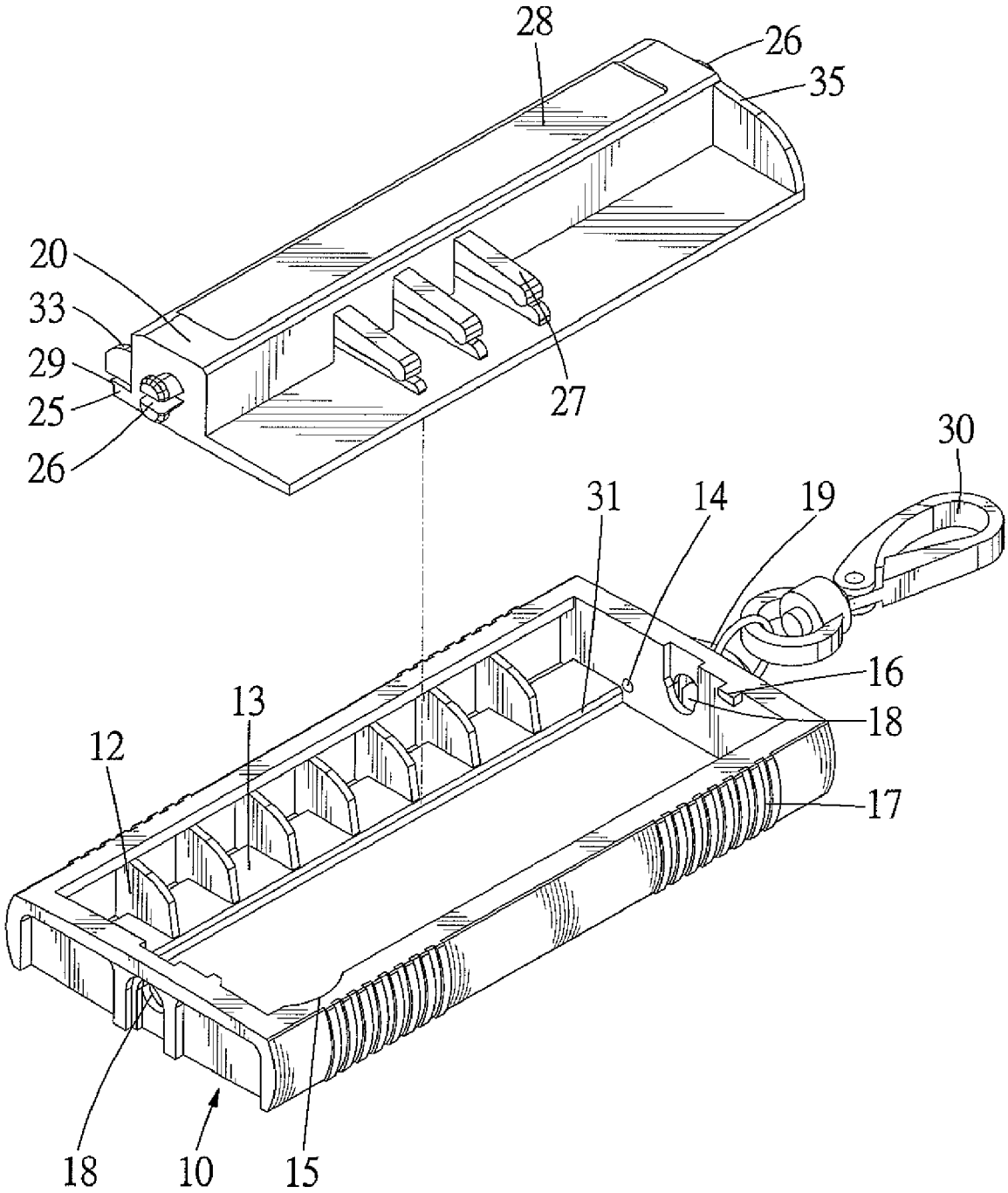
FIG. 2 is an explode view of the portable toolbox shown in FIG. 1.
Figure 3:
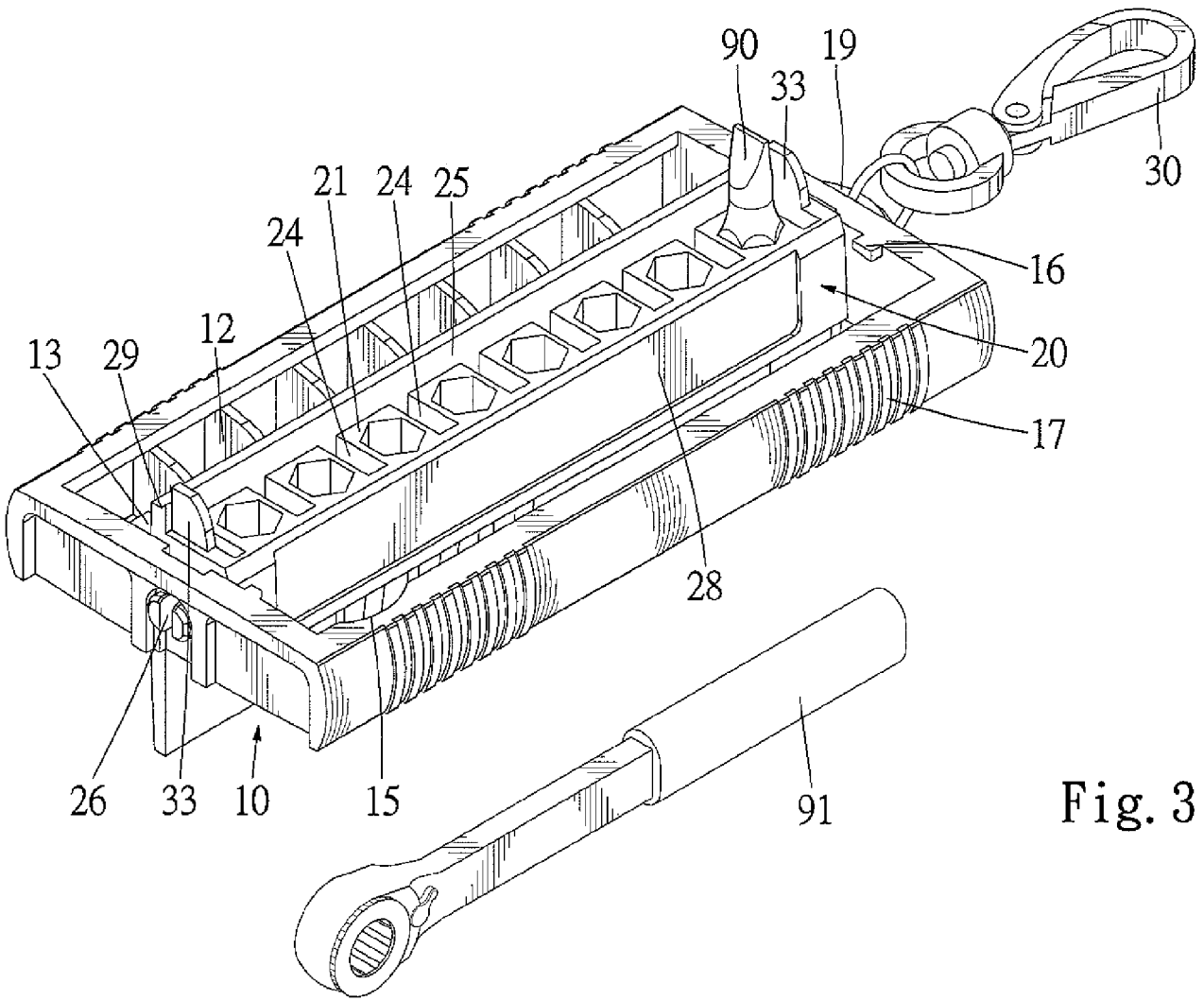
FIG. 3 is similar to FIG. 1 but shows a holder in an extended position relative to a frame.

Referring to FIGS. 1 through 3, a portable toolbox according to the preferred embodiment of the present invention is shown. The portable toolbox includes a frame 10 and a holder 20.

The frame 10 includes two short members and two long members formed between the short members. The frame 10 includes a board 13 formed on an internal side next to one of the long members and a plurality of partitions 12 formed on the board 13 in order to define a plurality of rooms each for receiving a bit 90. The board 13 includes a chamfered edge 31.

A hole 18 is defined in the internal side of each short member of the frame 10. A boss 14 is formed on the internal side of each short member of the frame 10. A stop 16 is formed on the internal side of each short member of the frame 10.

A hook 30 is connected with a loop 19 formed on an external side of one of the short members of the frame 10 for hanging the portable toolbox on a belt worn on a user's waist. The hook 30 is elastic.

In the internal side of each long member of the frame 10 is defined a recess 15 for receiving a head of a spanner 91. On an internal side of each long member of the frame 10 are formed two non-slip sections 17 in order to facilitate the holding of the frame 10.

The holder 20 is pivotally put in the space 11 of the frame 10. The holder 20 includes two joints 26 inserted in the holes 18 of the frame 10 so that the holder 20 is pivotally connected with the frame 10. The holder 20 can be pivoted to about 90 degrees relative to the frame 10.

The holder 20 includes a base 25 formed thereon. The base 25 includes a tapered edge 29 formed thereon for matching the chamfered edge 31 of the board 13 of the frame 10 so that the holder 20 is kept in a retreated position relative to the frame 10. The base 25 includes two protrusions 33 formed thereon each for contact with the board 13 of the frame 10 so that the holder 20 is kept in the retreated position relative to the frame 10. The base 25 of the holder 20 abuts the bosses 14 of the frame 10 so that the holder 20 is kept in the retreated position relative to the frame 10.

The holder 20 includes an end plate 35 formed thereon for abutment against one of the stops 16 of the frame 10 so that the holder 20 is kept in the retreated position relative to the frame 10. The holder 20 includes three clips 27 formed thereon for pinching a spanner 91 in order to avoid the spanner 91 escaping from the holder 20.

The holder 20 includes a plurality of sockets 21 formed thereon each for receiving corresponding one of the bits 90. Each of the sockets 21 includes a detent 23 formed on an internal (see FIG. 4) for abutment against one of the bits 90 in order to avoid the bit 90 escaping from the socket 21 when the user stoops. A gap 24 exists between any adjacent sockets 21 in order to allow the deformation of the sockets 21, thus improving the flexibility of the sockets 21.

The holder 20 includes a mark plate 28 formed thereon. The mark plate 28 can be printed or written by characters or a pattern.

Figure 4:
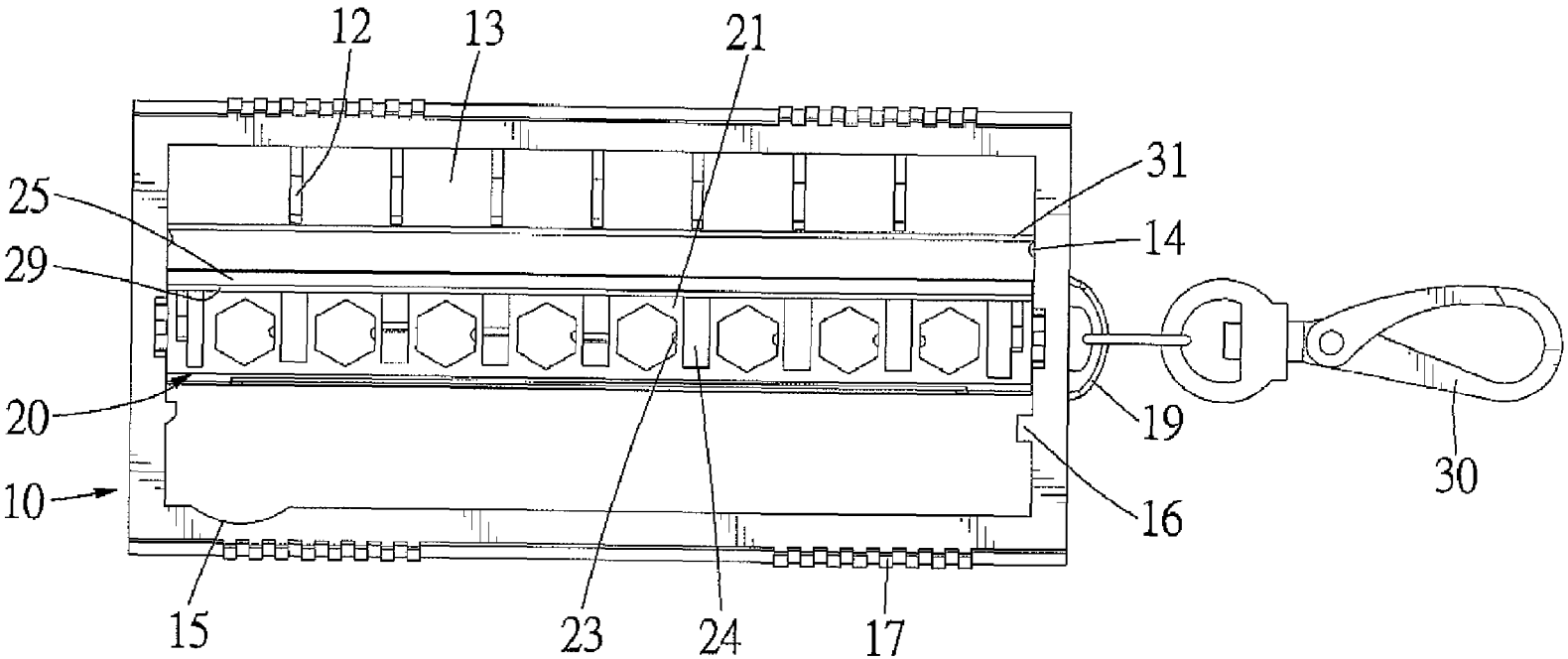
FIG. 4 is a top view of the portable toolbox shown in FIG. 3.

Referring to FIG. 4, the holder 20 is in an extended position relative to the frame 10.

Figure 5:
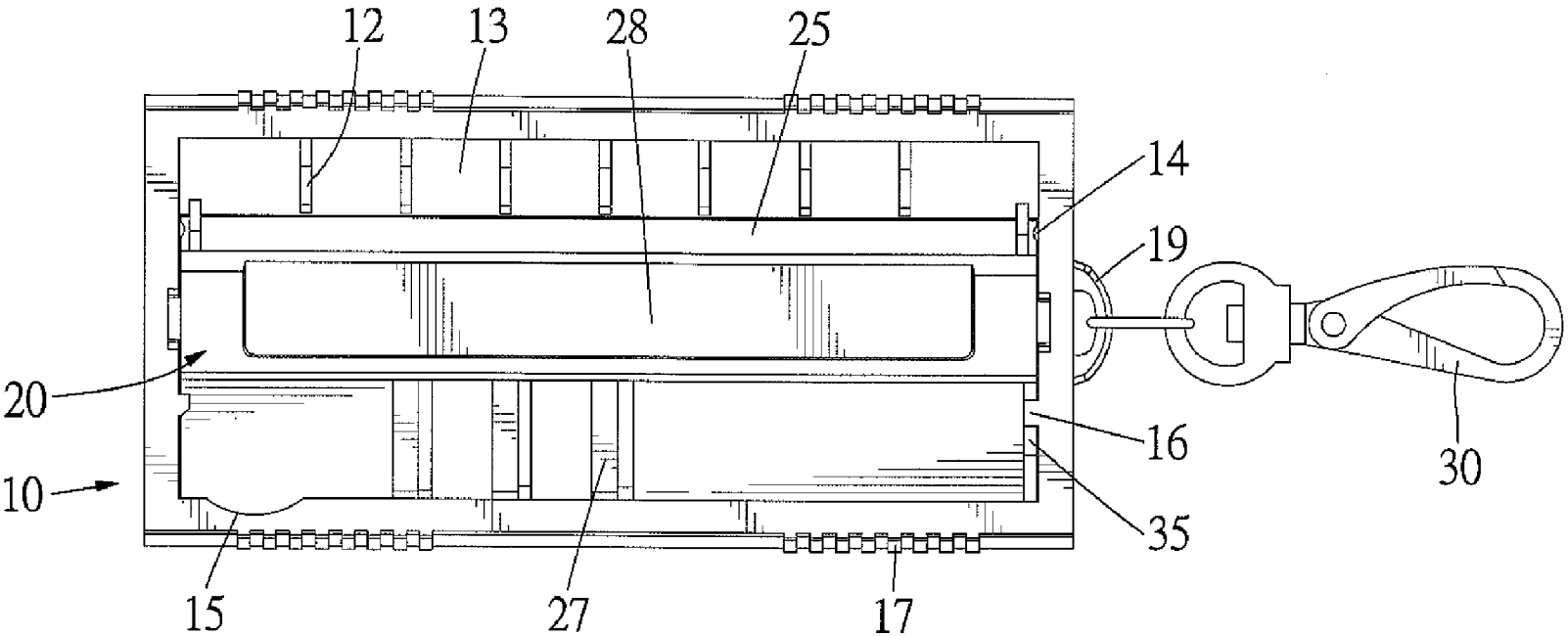
FIG. 5 is a top view of the portable toolbox shown in FIG. 1.

Referring to FIG. 5, the holder 20 is in the retreated position relative to the frame 10.

Figure 6:
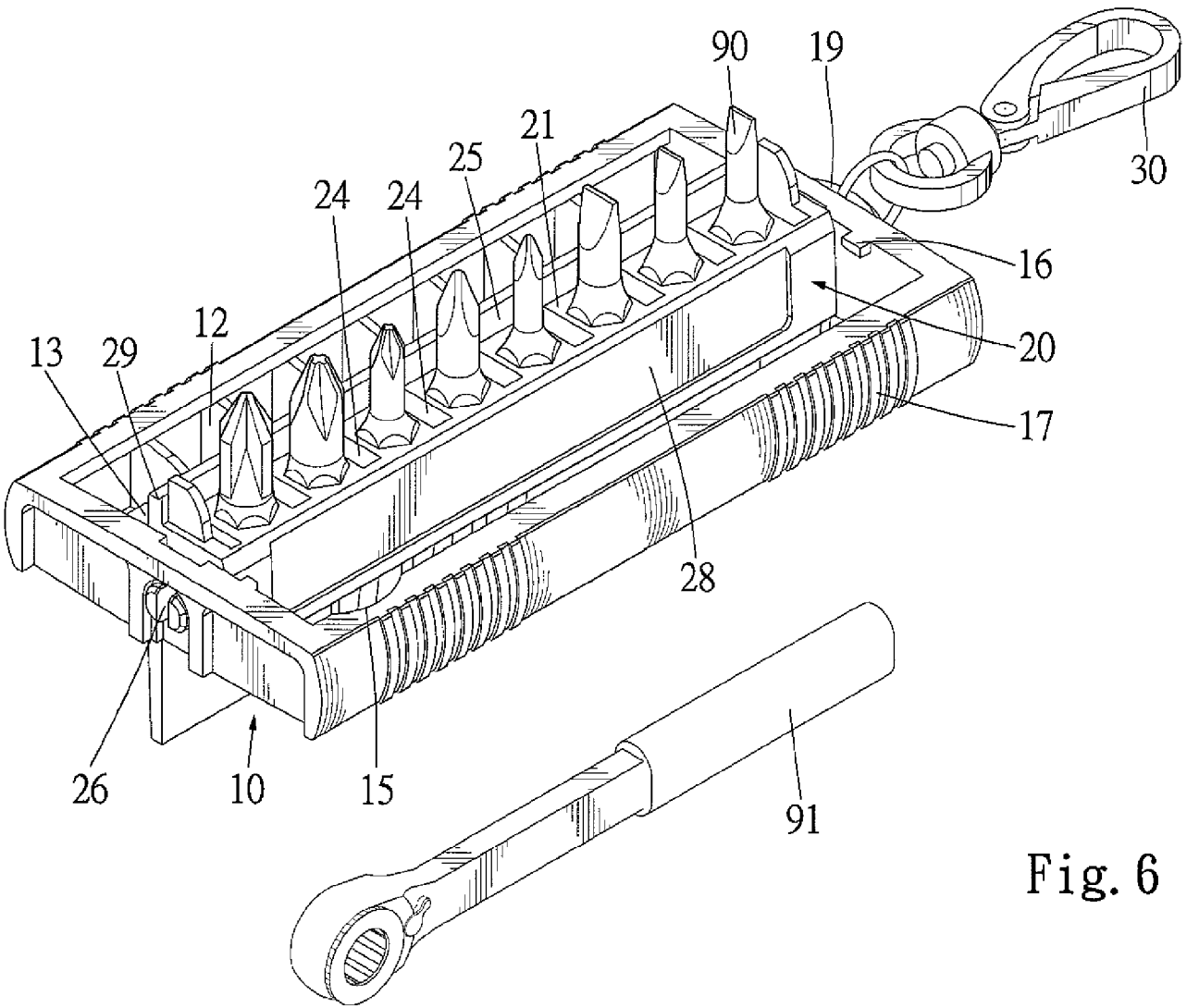
FIG. 6 is similar to FIG. 3 but shows a plurality of bits held by means of the holder.

Referring to FIG. 6, bits 90 are put in the sockets 21.

The present invention has been described through detailed illustration of the preferred embodiment. Those skilled in the art can derive variation from the preferred embodiment without departing from the scope of the present invention. Therefore, the preferred embodiment shall not limit the scope of the present invention defined in the claims.

What is claimed is:

1. A portable toolbox comprising:

a frame having an axis, a long member, a board and two short members, with the axis extending through the two short members, with the long member extending in a parallel direction to the axis, with the long member located between the two short members, with the board formed on the long member, with the board extending toward the axis, wherein the board has a chamfered edge;

a holder pivotally connected to the frame about the axis of the frame and moveable between a retreated position and an extended position, wherein the holder comprises:

a plurality of sockets formed on the holder, with the plurality of sockets for receiving a plurality of bits; and a base extending parallel to and spaced from the plurality of sockets, with the base having a tapered edge, with the tapered edge being chamfered to match the chamfered edge of the board of the frame, with the chamfered edge of the board abutting with the tapered edge of the base when the holder is in the retreated position and preventing movement beyond the retreated position away from the extended position, wherein the base defines a base thickness, wherein the board defines a board thickness, with the board thickness being equal to the base thickness, with the chamfered edge and the tapered edge creating a single board defining a single board thickness when the chamfered edge is abutting with the tapered edge, with the board thickness, the base thickness and the single board thickness being equal when the chamfered edge is abutting with the tapered edge and preventing movement beyond the retreated position away from the extended position.

2. The portable toolbox according to claim 1 wherein the holder further comprises two joints formed on the holder, wherein the frame defines two holes each receiving a related one of the two joints to pivotally connect the holder with the frame about the axis of the frame.

3. The portable toolbox according to claim 1 wherein the base further comprises at least one protrusion, with the at least one protrusion contacting the board when the holder is in the retreated position and preventing movement beyond the retreated position away from the extended position.

4. The portable toolbox according to claim 1 wherein the frame further comprises a boss formed on each of the two short members of the frame, with the boss abutting against the base when the holder is in the retreated position and impermanently keeping the holder in the retreated position.

5. The portable toolbox according to claim 1 wherein the frame further comprises at least one stop formed on one of the two short members of the frame, wherein the holder further comprises an end plate formed on the holder, with the end plate abutting against the at least one stop when the holder is in the retreated position and preventing movement beyond the retreated position away from the extended position.

6. The portable toolbox according to claim 1 wherein the frame further comprises at least one partition formed on the board to define two spaces for receiving a plurality of bits.

7. The portable toolbox according to claim 1 wherein the holder further comprises at least one clip formed on the holder, with the at least one clip for pinching at least one tool to avoid the at least one tool escaping from the holder.

8. The portable toolbox according to claim 7 wherein the frame further comprises a recess defined in the frame for receiving the at least one tool.

9. The portable toolbox according to claim 1 wherein each socket of the plurality of sockets comprises one detent formed on the each socket, with the one detent formed on the each socket abutting against a related bit of the plurality of bits to avoid the related bit escaping from the each socket.

10. The portable toolbox according to claim 1 wherein a gap is defined between any adjacent two sockets of the plurality of sockets to allow deformation of the plurality of sockets and improving the flexibility of the plurality of sockets.

11. The portable toolbox according to claim 1 wherein the plurality of sockets are elastic.

12. The portable toolbox according to claim 1 wherein the frame further comprises at least one non-slip section formed on the frame to facilitate holding of the frame.

13. The portable toolbox according to claim 1 wherein the frame further comprises a loop formed on the frame and a hook connected with the loop.

14. The portable toolbox according to claim 13 wherein the hook is a flexible hook.

15. The portable toolbox according to claim 1 wherein the holder further comprises a mark plate formed on the holder.

16. The portable toolbox according to claim 1 wherein the holder is pivotable by 90 degrees between the retreated position and the extended position.

17. A combination comprising:

a plurality of bits;

a tool; and a portable toolbox, with the portable toolbox further comprising:

a frame having an axis, a long member, a board and two short members, with the axis extending through the two short members, with the long member extending in a parallel direction to the axis, with the long member located between the two short members, with the board formed on the long member, with the board extending toward the axis, wherein the board has a chamfered edge;

a holder having a plurality of holes to receive the plurality of bits, with the holder pivotally connected to the frame for movement between a retreated position and an extended position about the axis of the frame, with the holder comprising:

a base having a tapered edge, with the base extending parallel to and spaced from the plurality of sockets, with the tapered edge being chamfered to match the chamfered edge of the board of the frame, wherein the chamfered edge of the board abuts with the tapered edge of the holder when the holder is in the retreated position, with the frame keeping the plurality of bits in the holder when the holder is in the retreated position, with the tool removeably attached to the holder, wherein the board supports the plurality of bits held by the holder in the retreated position and preventing movement of the holder beyond the retreated position away from the extended position.

* * * * *